United States Patent [19]

Bottenberg et al.

[11] 4,315,827

[45] Feb. 16, 1982

[54] LOW-VAPOR-PRESSURE FERROFLUIDS AND METHOD OF MAKING SAME

[75] Inventors: William R. Bottenberg, Thousand Oaks, Calif.; Mark S. Chagnon, Lowell, Mass.

[73] Assignee: Ferrofluidics Corporation, Nashua, N.H.

[21] Appl. No.: 234,561

[22] Filed: Feb. 13, 1981

Related U.S. Application Data

[63] Continuation of Ser. No. 92,369, Nov. 8, 1979, abandoned.

[51] Int. Cl.[3] ..... H01F 10/10

[52] U.S. Cl. ..... 252/62.51; 252/62.52

[58] Field of Search ..... 252/62.51 R, 62.52, 252/62.53

[56] References Cited

U.S. PATENT DOCUMENTS

| | | | |
|---|---|---|---|
| 3,247,245 | 4/1966 | Teot et al. | 568/636 X |
| 3,620,589 | 11/1971 | Rosensweig | 308/187.1 |
| 3,700,595 | 10/1972 | Kaiser | 252/62.56 |
| 3,764,540 | 10/1973 | Khalafalla et al. | 252/62.53 |
| 3,917,538 | 11/1975 | Rosensweig | 252/62.51 R |
| 4,019,994 | 4/1977 | Kelley | 252/62.52 |

OTHER PUBLICATIONS

Chopey, Chemical Engineering, vol. 67, No. 9, pp. 77, 78, May 1960.

*Primary Examiner*—F. Edmundson
*Attorney, Agent, or Firm*—Richard P. Crowley

[57] ABSTRACT

A stable ferrofluid composition which comprises a colloidal dispersion of finely-divided magnetic particles in a liquid, low-pressure, polyphenyl ether carrier and a dispersing amount of a surfactant, which surfactant comprises a polyphenyl ether surfactant containing a functional group, such as an acidic group, and an aromatic tail group which is soluble in the polyphenyl ether carrier, to provide a stable ferrofluid composition.

29 Claims, No Drawings

LOW-VAPOR-PRESSURE FERROFLUIDS AND METHOD OF MAKING SAME

This is a continuation of application Ser. No. 92,369, filed Nov. 8, 1979 (now abandoned).

BACKGROUND OF THE INVENTION

Ferromagnetic liquids commonly are referred to as ferrofluids and typically comprise a colloidal dispersion of finely-divided magnetic particles, such as iron, $\alpha Fe_2O_3$ (hematite), magnetite and combinations thereof, of subdomain size, such as, for example, 10 to 800 Angstroms, and more particularly 50 to 500 Angstroms, dispersed in a liquid through the use of a surfactant-type material. Typically ferrofluids are remarkably unaffected by the presence of applied magnetic fields or by other force fields, and the magnetic particles remain uniformly dispersed throughout the liquid carrier. Ferrofluid compositions are widely known, and typical ferrofluid compositions are described, for example, in U.S. Pat. Nos. 3,700,595, issued Oct. 24, 1972, and 3,764,540, issued Oct. 9, 1973, while a particular process for preparing such ferrofluid compositions is described more particularly in U.S. Pat. No. 3,917,538, issued Nov. 4, 1975, which describes a grinding or ball-mill technique for preparing ferrofluid compositions, and U.S. Pat. No. 4,019,994, issued Apr. 26, 1977, describing more particularly a precipitation technique for preparing ferrofluid compositions.

Ferrofluids have been suggested to be prepared using a wide variety of liquid carriers. However, current state-of-the-art ferrofluids typically employ a hydrocarbon carrier or, for example, a diester liquid, such as ethyl-hexyl azilate. Liquid ferrofluids typically comprise a dispersion of colloidal magnetite stabilized by an aliphatic surfactant in a hydrocarbon-liquid carrier, such as, for example, the use of an oleic-acid-type surfactant. These diester ferrofluids have found use in audio-voice-coil-damping and inertia-damping apparatus and for use in bearings and seals. However, the hydrocarbon-based, and particularly the diester-based ferrofluids have been limited in some applications, paricularly in seals, because of a relatively high vapor pressure of the carrier of greater than about $10^{-4}$ torr at 20° C.

Ferrofluids have been employed in single and multistage seals (see, for example, U.S. Pat. No. 3,620,584, issued Nov. 16, 1971), which seals are used in the vacuum industry. Attempts to provide stable, low-vapor-pressure, ferrofluid compositions, particularly for use at $10^{-4}$ torr or more, particularly equal to or less than $10^{-7}$ torr, have not been commercially successful. Accordingly, there exists a need for stable, low-vapor-pressure ferrofluids for seals and other uses and for a method of manufacturing such ferrofluid compositions.

SUMMARY OF THE INVENTION

Our invention relates to improved ferrofluid compositions, the method of making the compositions and the use of such improved ferrofluid compositions. In particular, our invention concerns an improved stable, polyphenyl-ether-based, ferrofluid composition. More particularly, our invention is directed to an improved stable, low-vapor-pressure, ferrofluid composition, particularly useful in seals under vacuum, and the method of making said ferrofluids.

We have discovered that stable ferrofluids may be prepared employing polyphenyl ether as a carrier liquid, which ferrofluids are characterized by a low vapor pressure of less than $10^{-4}$ torr; for example, $10^{-7}$ torr, at 20° C., and, therefore, are particularly suitable for use in seals or other uses where low vapor pressure is desirable. Our stable ferrofluids are prepared employing a surfactant, wherein the surfactant contains a functional group which forms a chemical bond with the surface of the subdomain magnetic particles employed in the ferrofluid, such as, for example, a functional group that is capable of forming a complex, such as a coordination complex, or by entering into a chemical reaction with the surface of the magnetic particles. The surfactant may be the same as or different from the polyphenyl ether carrier of the ferrofluid carrier, but preferably is of the same general structure, which results in a stable dispersion of the coated magnetic particles in the ferrofluid, since the functional head group provides for a bond with the magnetic particles, while the remaining or tail portion of the surfactant molecule is solubilized in the polyphenyl ether carrier liquid.

The stable ferrofluids of our invention are stable during storage or when subjected to a magnetic-force field or other force fields and, due to the nature of the liquid polyphenyl ether used as a carrier, exhibit very low vapor pressure.

It has been found that poly aromatic polyethers, particularly liquid polyphenyl ethers, are suitable for use as carrier liquids in ferrofluid compositions. Polyphenyl ethers have wide acceptance in the vacuum industry, due in part to very low vapor pressures. Our attempts to synthesize polyphenyl ether ferrofluid compositions with conventional surfactants, such as oleic and undecanoic acid, have not been successful, since unstable ferrofluids have resulted. It has been discovered that stable polyphenyl ether ferrofluid compositions can be produced employing certain surfactants.

Our invention comprises a stable ferrofluid composition, and particularly those ferrofluid compositions having a carrier liquid with a low vapor pressure, which ferrofluid comprises finely-divided magnetic particles, typically, for example, less than 800 Angstroms; for example, 20 to 500 Angstroms, and more particularly 50 to 150 Angstroms in particle size, colloidally dispersed in a polyphenyl ether carrier liquid and a small, but effective, amount of a surfactant, typically a surfactant wherein the surfactant contains a functional group which forms a chemical bond, such as forming a complex or reactant with the surface of the magnetic particles, a tail group of sufficient length and structure that is miscible or soluble in the polyphenyl ether carrier liquid, with a linking group between the head and tail groups that is of sufficient length and rigidity to direct the head group toward the magnetic particles and to separate the head and tail groups from one another. Our invention also is directed to a method of preparing the improved stable ferrofluids, wherein a polyphenyl ether is employed as the liquid carrier, either through a grinding, precipitating or other technique of preparing ferrofluids, and a surfactant is employed containing a reactive functional group and proper tail group in the preparation of the ferrofluid composition.

In general, our invention relates to the use of surfactants to produce gravitationally and magnetically stable ferrofluid compositions, wherein magnetic particles can be dispersed in a low-pressure liquid carrier. The surfactants used may have the general structural formula:

$$R''—R'—R—YH$$

and contain a functional reactive polar group which has an active hydrogen and which reacts or forms a chemical complex or bond with the surface of the magnetic particles, such as the iron atoms of the activated finely-divided magnetite particles. The YH head or polar group is separated by and linked to an R group (which is optional) which is linked to an R′ group. The R′ group, typically an organic group, is of sufficient length and rigidity to separate the polar head group YH from the R″ tail portion of the surfactant. R′ and R may be the same or different groups. The R″ group is selected to be soluble in and generally is the same or similar in chemical structure and/or properties as the carrier liquid, so that the R″ group will be a carrier-soluble tail with the polar head group YH attached to the magnetic particles.

The surfactants of choice will be illustrated in use for the preparation of polyphenyl ether, carrier-liquid ferrofluid compositions; however, it is recognized that the surfactants of the general type described may be employed with other matching liquid carriers, to provide a wide variety of stable ferrofluid compositions.

The liquid carriers of our ferrofluid composition are those aromatic high-molecular-weight polyethers which exhibit a low vapor pressure and include those low-pressure poly aromatic polyethers typically used in the vacuum industry and preferably polyphenyl ethers, such as those disclosed in U.S. Pat. No. 3,451,061, issued June 17, 1969, hereby incorporated by reference and similar polyether liquids. Useful polyphenyl ethers are typically liquids at 15° C. to 20° C. and have a repetitive chemical structure.

Typical polyphenyl ethers useful as carrier liquids have the structural formula:

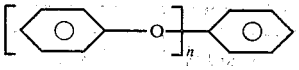

wherein n ranges from 1 to 6; for example, 1 to 4, and preferably is 3 to 4.

The polyphenyl ether may be substituted or unsubstituted. The polyphenyl ether may be used alone or in various polyphenyl ether combinations, or, if desired, with other low-vapor-pressure carrier liquids.

The magnetic particles employed in the ferrofluid may be those typical magnetic particles, either prepared by grinding or precipitation, but typically are finely-divided magnetizable particles usually recognized as magnetite, such as magnetite gamma iron oxide, chromium dioxide, ferrites and similar materials, and which materials also may include various elements and metallic alloys. The preferred materials are magnetite, gamma iron oxide ($Fe_3O_4$) and ($\alpha Fe_2O_3$), wherein the magnetic particles are present usually in an amount of from about 1% to 20%; for example, 2% to 12%, by volume of the ferrofluid.

The surfactant or stabilizing agents employed comprise those surfactants which include at least polar-reactive or -functioning groups, a linking group and a long-chain polyphenyl ether soluble tail. Typically, the surfactant may be present in an amount sufficient to provide the desired colloidal dispersion and stability to the ferrofluid composition, and generally is used in a ratio of surfactant-to-magnetic-particles of from about 1:2 to 1:20 by volume; for example, 1:1 to 1:5 by volume. If desired and applicable, the liquid carrier may be used alone or in conjunction with other liquid-carrier materials or other additive materials. The surfactant employed may be used alone or in combination with other types of surfactants where necessary or required, such as those carboxylic acids or other dispersants or surface-active agents useful in the dispersing or stabilizing of magnetite particles.

Representative polar groups YH of the surfactant typically include carboxylic acids (—COOH), alcohols (—OH), amines ($—NH_2$), aldehydes

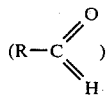

and mercaptans (—SH) among other compounds with so-called active hydrogen groups. The tail groups R″ include molecules with phenyl, benzyl or phenoxy moieties of various lengths and degrees of isomerization. The linking groups R′ may consist of numerous aliphatic or aromatic structures whose isomeric structures and lengths may be varied in nature.

Some types of surfactant that result in stable ferrofluids in polyphenyl ethers should include, but are not limited to: phenoxy-terminated aliphatic acids, such as 11 phenoxy undecanoic acid; phenoxy-terminated alcohols, such as phenoxy, phenoxy phenol and O phenoxy benzyl alcohol; and phenoxy-terminated aromatic acids such as O phenoxy benzoic acid. To stabilize the colloid in higher-molecular-weight polyphenyl ethers, such as pentaphenyl ether (Nye synthetic oil #438), the surfactant may require more than a single phenoxy unit in its structure.

We have found that the use of undecanoic acid as a surfactant with a four-ring polyphenyl ether carrier liquid is unsatisfactory; however, the use of the phenoxy-terminated undecanoic acid provides stable ferrofluid compositions. The preferred surfactants comprise:

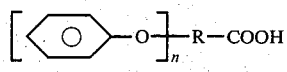

wherein n is 1 to 6 and preferably 1 or 2, and R is a phenyl or benzyl or aliphatic radical; for example, a long-chain hydrocarbon, such as a $C_6$–$C_{18}$-saturated or -unsaturated radical, or where R and the carboxylic groups are a fatty-acid radical.

In the illustration given, the phenoxy group is the R″ tail group and the $C_{11}$ chain is the R′ linking group and the COOH is the polar YH group. It is recognized that mono, di or tri polar groups, such as moni, di and tri carboxylic groups, may be employed in the surfactant. The most preferred surfactants are those mono or di phenoxy long-chain $C_6$–$C_{16}$ aliphatic; for example, fatty carboxylic acid, surfactants. The surfactants may, if desired, have one or more polar YH groups of the same or different reactive structure, such as a surfactant with COOH and SH polar groups.

Thus, in practice, the solubilizing or tail groups of the surfactant permit a very stable dispersion by being solubilized easily in the carrier liquid, while the opposite end of the reacting group is secured or chemically bonded to the magnetite particles. The surfactant may be the same as or different from the carrier fluid, either in molecular weight, viscosity, chain length or isometric chemical characteristics.

Stable ferrofluid compositions may be prepared in polyphenyl ether liquid carriers by grinding the magnetite in a ball mill in a solution of the reactive surfactant and a solvent, such as a volatile organic solvent, and reacting the activated magnetite with the reactive groups of the surfactant in the solvent slurry, such as, for example, where the solvent is methylethyl ketone, acetone and a hydrocarbon like xylene, toluene or other volatile solvents.

Typical formulations for a grinding operation are:

| | |
|---|---|
| $Fe_3O$ | 10–300 gm |
| Surfactant | 1–100 gm |
| Solvent | 100–2000 ml |

After grinding for sufficient time to disperse the magnetite, the colloidal suspension of magnetite, surfactant and grinding solvent is removed from the ball mill. Separation of the surfactant-coated particles from the solvent may be achieved by evaporation or flocculation with acetone or other polar solvent. The sedimentated material is easily solubilized in a carrier liquid.

A typical formulation for a precipitation operation is:

| | |
|---|---|
| Activated magnetite | 10–100 gm |
| Surfactant | 10–100 gm |
| Acetone | 100–1000 ml |

The activated magnetite is slurried in acetone for 5 to 30 minutes. The surfactant is slowly added to the slurry during constant stirring. A material, that consists of surfactant-coated particles, precipitates from the solution, which material is readily soluble in a four-ring polyphenyl ether as a carrier liquid.

For the purpose of illustration only, our invention will be described in connection with certain embodiments; however, it is recognized that those persons skilled in the art may make various changes and modifications in the ferrofluid compositions and the method of preparing same, all without departing from the spirit and scope of our invention.

DESCRIPTION OF THE EMBODIMENTS

Example 1

Activated magnetite ($Fe_3O_4$) particles were prepared as follows: 260 grams $FeSO_4$, 460 ml 46% $FeCl_3$ and 100 ml water were mixed to dissolve the salts.

800 grams of ice were added to obtain a temperature of $-3°$ C. $Fe_3O_4$ was precipitated from the solution by the slow addition of a solution of 600 ml concentrated $NH_4OH$ and 400 cc water cooled to $+1°$ C. The $Fe_3O_4$ was magnetically separated from the salt/ammoniacal solution and was washed with 200-ml portions of hot water, 100-ml portions of acetone and 200-ml portions of xylene and was vacuum dried. The activated magnetite prepared in this or a similar manner was then used in the preparation of polyphenyl ether ferrofluid compositions.

Then 50 grams of the activated magnetite, 15.55 grams of 11, phenoxy undecanoic acid as the surfactant and 525.6 ml of xylene were dispersed for three days in a ball mill. The material was then flocculated with three 100-ml portions of heptane and redispersed with 8 ml of polyphenyl ether (4-ring Nye synthetic oil #433) as a carrier liquid. The product was a ferrofluid composition with a magnetization of 450 gauss and 1000 cp in viscosity.

Example 2

10 grams activated magnetite, 10 grams O phenoxy benzoic acid as a surfactant and 100 ml xylene were ground in a ball mill for 10 days. After flocculation with heptane, the material was redispersed in a 4-ring polyphenyl ether. The ferrofluid was about 100 gauss and had a viscosity of 500 cp.

Example 3

10 grams activated magnetite, 10 grams O phenoxy benzyl alcohol as a surfactant and 100 ml xylene were ground for 10 days. The material was only sightly magnetic with a gauss of about 50.

The stable, low-vapor-pressure ferrofluids so prepared are useful in multistage, ferrofluid, seal assemblies, particularly in the vacuum industry or for sealing or lubricating purposes, wherein polyphenyl ethers are desirable or useful.

What is claimed is:

1. A ferrofluid composition which comprises a colloidal dispersion of finely-divided magnetic particles in a liquid polyphenyl ether carrier and a dispersing amount of a surfactant, which surfactant comprises a surfactant containing a functional polar group which forms a chemical bond with the surface of the magnetic particles and a tail group containing phenyl, benzyl or phenoxy groups which are soluble in the carrier, and a linking group to separate the polar and tail groups, to provide a stable ferrofluid composition.

2. The ferrofluid composition of claim 1 wherein the surfactant comprises from 1:2 to 1:20 by volume of the magnetic particles.

3. The ferrofluid composition of claim 1 wherein the magnetic particles are activated magnetite particles.

4. The ferrofluid composition of claim 1 wherein the carrier liquid has a vapor pressure of about $10^{-4}$ torr or less at 20° C.

5. The ferrofluid composition of claim 1 wherein the functional polar group of the surfactant comprises a carboxylic, amine, mercaptan, aldehyde or alcohol group reactive with the surface of the magnetic particles.

6. The ferrofluid composition of claim 1 wherein the magnetic particles comprise from about 1% to 20% by volume of the ferrofluid composition.

7. The ferrofluid composition of claim 1 wherein the magnetic particles have a particle size of from about 20 to 500 Angstroms.

8. The ferrofluid composition of claim 1 wherein the carrier liquid has the structural formula:

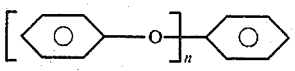

where n is a whole integer of from 1 to 6.

9. The ferrofluid composition of claim 1 wherein the linking group of the surfactant is an aliphatic group.

10. The ferrofluid composition of claim 1 wherein the surfactant is a phenoxy-, benzyl- or phenyl-terminated aliphatic or aromatic carboxylic acid or alcohol.

11. The ferrofluid composition of claim 1 wherein the surfactant is a phenoxy-terminated long-chain fatty acid.

12. The ferrofluid composition of claim 1 wherein the surfactant is selected from the group consisting of phenoxy benzoic acid, phenoxy undecanoic acid and phenoxy benzyl alcohol.

13. A ferrofluid composition which comprises:

(a) a colloidal dispersion of finely-divided, activated, magnetite particles, comprising from about 1% to 20% by volume of the ferrofluid composition, in a liquid polyphenyl ether carrier, the carrier liquid having the structural formula

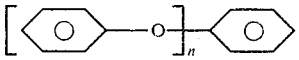

where n is a whole integer of from 1 to 6, and a dispersing amount of a phenoxy-, benzyl- or phenyl-terminated aliphatic or aromatic carboxylic acid or alcohol surfactant comprising from 1:2 to 1:20 by volume of the magnetite particles, which surfactant comprises a surfactant containing a functional polar group which forms a chemical bond with the surface of the magnetite particles and a tail group containing phenyl, benzyl or phenoxy groups which are soluble in the carrier; and (b) a linking group to separate the polar and tail groups, to provide a stable ferrofluid composition.

14. The ferrofluid composition of claim 13 wherein the surfactant is selected from the group consisting of phenoxy benzoic acid, phenoxy undecanoic acid and phenoxy benzyl alcohol.

15. In a method of preparing a stable ferrofluid composition, which method comprises dispersing finely-divided magnetic particles in a liquid with a dispersing amount of a surfactant to form a colloidal dispersion of a ferrofluid composition, the improvement which comprises employing as the liquid carrier a liquid polyphenyl ether and as the surfactant a surfactant having a functional polar group reactive with the surface of the magnetic particles during the dispersion, to form a chemical bond with the magnetic particles and a tail group containing phenyl, benzyl or phenoxy groups which are soluble in the carrier, and a linking group to separate the polar and tail groups, to provide a stable ferrofluid composition.

16. The method of claim 15 wherein the surfactant comprises from 1:2 to 1:20 by volume of the magnetic particles.

17. The method of claim 15 wherein the magnetic particles are activated magnetite particles.

18. The method of claim 15 wherein the carrier liquid has a vapor pressure of about $10^{-7}$ torr or less at 20° C.

19. The method of claim 15 wherein the carrier liquid has the structural formula:

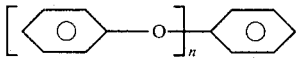

where n is a whole integer of from 1 to 6.

20. The method of claim 15 wherein the surfactant is a phenoxy-, benzyl- or phenyl-terminated aliphatic or aromatic carboxylic acid or alcohol.

21. The method of claim 15 wherein the surfactant is selected from the group consisting of phenoxy benzoic acid, phenoxy undecanoic acid and phenoxy benzyl alcohol.

22. The ferrofluid composition of claim 1 wherein the surfactant comprises a phenoxy-terminated undecanoic acid and the liquid polyphenyl ether carrier comprises a four-ring polyphenyl ether carrier.

23. The ferrofluid composition of claim 1 wherein the surfactant comprises a mono or di phenoxy long-chain $C_6$–$C_{16}$ aliphatic carboxylic acid.

24. The method of claim 15 wherein the surfactant comprises a phenoxy-terminated undecanoic acid and the liquid polyphenyl ether carrier comprises a four-ring polyphenyl ether carrier.

25. The method of claim 15 wherein the surfactant comprises a mono or di phenoxy long-chain $C_6$–$C_{16}$ aliphatic carboxylic acid.

26. The method of claim 15 wherein the functional polar group of the surfactant comprises a carboxylic, amine, mercaptan, aldehyde or alcohol group reactive with the surface of the magnetic particles.

27. The method of claim 15 which includes:

(a) grinding the magnetite in a ball mill to disperse the magnetic particles in a solution of the surfactant and a solvent, to form a colloidal suspension of the magnetic particles, surfactant and solvent;

(b) separating the surfactant-coated magnetic particles from the solvent; and (c) dispersing the surfactant-coated magnetic particles in the carrier liquid.

28. The method of claim 27 which includes separating the magnetic particles from the solvent by evaporating the solvent.

29. The method of claim 28 which includes separating the magnetic particles from the solvent by flocculating with the addition of a polar solvent.

* * * * *